United States Patent [19]

Wittchow

[11] Patent Number: 4,869,210

[45] Date of Patent: Sep. 26, 1989

[54] METHOD OF OPERATING A ONCE-THROUGH STEAM GENERATOR

[75] Inventor: Eberhard Wittchow, Erlangen, Fed. Rep. of Germany

[73] Assignee: Siemens Aktiengesellschaft, Munich, Fed. Rep. of Germany

[21] Appl. No.: 247,076

[22] Filed: Sep. 20, 1988

[30] Foreign Application Priority Data

Sep. 21, 1987 [DE] Fed. Rep. of Germany ..... 3731728

[51] Int. Cl.[4] ..... F22D 5/26

[52] U.S. Cl. ..... 122/451 S; 122/406 S; 122/406 ST

[58] Field of Search ..... 122/406 S, 406 ST, 451 S, 122/504, 507

[56] References Cited

U.S. PATENT DOCUMENTS

| | | | |
|---|---|---|---|
| 3,220,193 | 11/1965 | Strohmeyer, Jr. | 122/406 S |
| 3,260,246 | 7/1966 | Zwetz | 122/451 S |
| 3,434,460 | 3/1969 | Schroedter | 122/406 S |
| 3,478,726 | 11/1969 | Kikimis | 122/406 S |
| 4,261,301 | 4/1981 | Lösel et al. | 122/406 S |
| 4,290,390 | 9/1981 | Juzi | 122/406 S |
| 4,520,762 | 6/1985 | Martin | 122/406 ST |

FOREIGN PATENT DOCUMENTS

| | | |
|---|---|---|
| 1146071 | 3/1963 | Fed. Rep. of Germany . |
| 2950622 | 10/1981 | Fed. Rep. of Germany . |
| 2121184 | 8/1972 | France . |
| 768201 | 2/1957 | United Kingdom . |

OTHER PUBLICATIONS

VGB Kraftwerkstechnik 56, Book 12, Dec. 1976, pp. 751–753.

*Primary Examiner*—Edward G. Favors

*Attorney, Agent, or Firm*—Herbert L. Lerner; Laurence A. Greenberg

[57] ABSTRACT

A method of operating a once-through steam generator having a first evaporator heating surface formed of a tube wall of a combustion chamber, and a second evaporator heating surface connected in parallel to the first evaporator heating surface at a water inlet side thereof, the second evaporator heating surface being located in a convection chamber post-connected to the combustion chamber at a flue-gas outlet side thereof downstream from a superheating surface as viewed in a flow direction of flue gas, includes opening a water regulating valve preconnected to the second evaporator heating surface in the flow direction of the feedwater, if a predetermined value of a mass flow of the feedwater into the once-through stem generator is exceeded, so as to initiate a partial mass flow of the feedwater into the second evaporator heating surface; and closing the water regulating valve again, if the predetermined value fails to be attained, so as to terminate the partial mass flow of the feedwater into the second evaporator heating surface.

3 Claims, 2 Drawing Sheets

METHOD OF OPERATING A ONCE-THROUGH STEAM GENERATOR

The invention relates to a method of operating a once-through steam generator having a first evaporator heating surface formed of a tube wall of a combustion chamber, and a second evaporator heating surface connected in parallel to the first evaporator heating surface at a water inlet side thereof, the second evaporator heating surface being located in a convection chamber post-connected to the combustion chamber at a flue-gas outlet side thereof downstream from a superheating surface as viewed in a flow direction of flue gas.

A method of this general type has become known heretofore from "VGB - Kraftwerkstechnik 56" (Power Plant Technology, Journal of the Association of Power Plant Operators), No. 12, Dec. 1976, pages 751–753, and is concerned with a once-through steam generator with full-load circulation of a combined gas and steam turbine installation. A constant quantity of exhaust gas flows from a gas turbine to the once-through steam generator independently of the load thereof. Excess air in the combustion chamber is kept approximately the same at all times despite a varying load of the once-through steam generator, due to the fact that a partial flow of this exhaust gas of the gas turbine is introduced into the convection chamber at the flue-gas side upstream from the second evaporator heating surface, bypassing the combustion chamber and thereby bypassing the first evaporator heating surface formed by the wall of the combustion chamber of the once-through steam generator. The feedwater is directed continuously into both evaporator heating surfaces, which are connected parallel to one another, in proportions that are always self-adjusting.

At full load of the once-through steam generator, evaporation takes place in both of the evaporator heating surfaces. With decreasing load, the first evaporator heating surface formed by the wall of the combustion chamber absorbs less and less heat until, at low load, the first evaporator heating surface functions only as a feedwater preheater, while the majority of heat transfer occurs to the second evaporator heating surface in the convection chamber.

It is an object of the invention to provide a method of operating a once-through steam generator whereby the drive power of the feedwater pump for the once-through steam generator is reduced, especially at full load of the steam generator, and thereby not only minimizing investment costs for a feedwater pump, a feedwater preheater and a feedwater pipeline, but also making the operation of the once-through steam generator more economical.

With the foregoing and other objects in view, there is provided, in accordance with the invention, a method of operating a once-through steam generator having a first evaporator heating surface formed of a tube wall of a combustion chamber, and a second evaporator heating surface connected in parallel to the first evaporator heating surface at a water inlet side thereof, the second evaporator heating surface being located in a convection chamber post-connected to the combustion chamber at a flue-gas outlet side thereof downstream from a superheating surface as viewed in a flow direction of flue gas, which comprises opening a water regulating valve preconnected to the second evaporator heating surface in the flow direction of the feedwater, if a predetermined value of a mass flow of the feedwater into the once-through steam generator is exceeded, so as to initiate a partial mass flow of the feedwater into the second evaporator heating surface; and closing the water regulating valve again, if the predetermined value fails to be attained, so as to terminate the partial mass flow of the feedwater into the second evaporator heating surface.

As a result of this invention, the mass flow of the feedwater into the first evaporator heating surface formed by the wall of the combustion chamber does not increase further above a predetermined load of the once-through steam generator, but instead, the necessary increased quantity of the mass flow of feedwater as the load continues to increase flows into the second evaporator heating surface located in the convection chamber. consequently, the flow speed and the friction pressure loss in the first evaporator heating surface, accordingly, do not continue to rise, and the feedwater pump has to overcome only this friction pressure loss, even at full load, because of the second evaporator heating surface connected parallel thereto at the water inlet side.

Moreover, at partial load, the second evaporator heating surface, which is located in the convection chamber and is shut off, has no flow therethrough and is thereby not cooled, so that it, in turn, cannot cool the flue gas in the convection chamber. The flue gas therefore has a temperature which is sufficiently high that an installation provided with catalysts for removing nitric oxide from the flue gas and post-connected to the convection chamber can function satisfactorily.

In accordance with another measure, the method according to the invention includes varying the opening of the water regulating valve to adjust the partial mass flow of the feedwater into the second evaporator heating surface so that the partial mass flow of the feedwater into the first evaporator heating surface does not exceed a predetermined value.

The friction pressure loss to be overcome by the feedwater pump, to the extent that it occurs in the first evaporator heating surface, can thus be adjusted to a minimum possible value, so that the power of the feedwater pump can likewise be adjusted to a minimum possible value.

In accordance with a concomitant measure, the method of the invention includes respectively increasing and reducing momentarily the mass flow of feedwater into the once-through steam generator.

Temperature fluctuations occurring as a result of a load change or faulty or disrupted firing in other heating surfaces post-connected to the two evaporator heating surfaces at the water inlet side thereof can thus be compensated for.

Other features which are considered as characteristic for the invention are set forth in the appended claims.

Although the invention is illustrated and described herein as a method of operating a once-through steam generator, it is nevertheless not intended to be limited to the details shown, since various modifications and changes may be made therein without departing from the spirit of the invention and within the scope and range of equivalents of the claims.

The constructions and method of operation of the invention, however, together with additional objects and advantages thereof will be best understood from the following description of specific measures and embodiments when read in connection with the accompanying drawings, in which.

Figure 1:
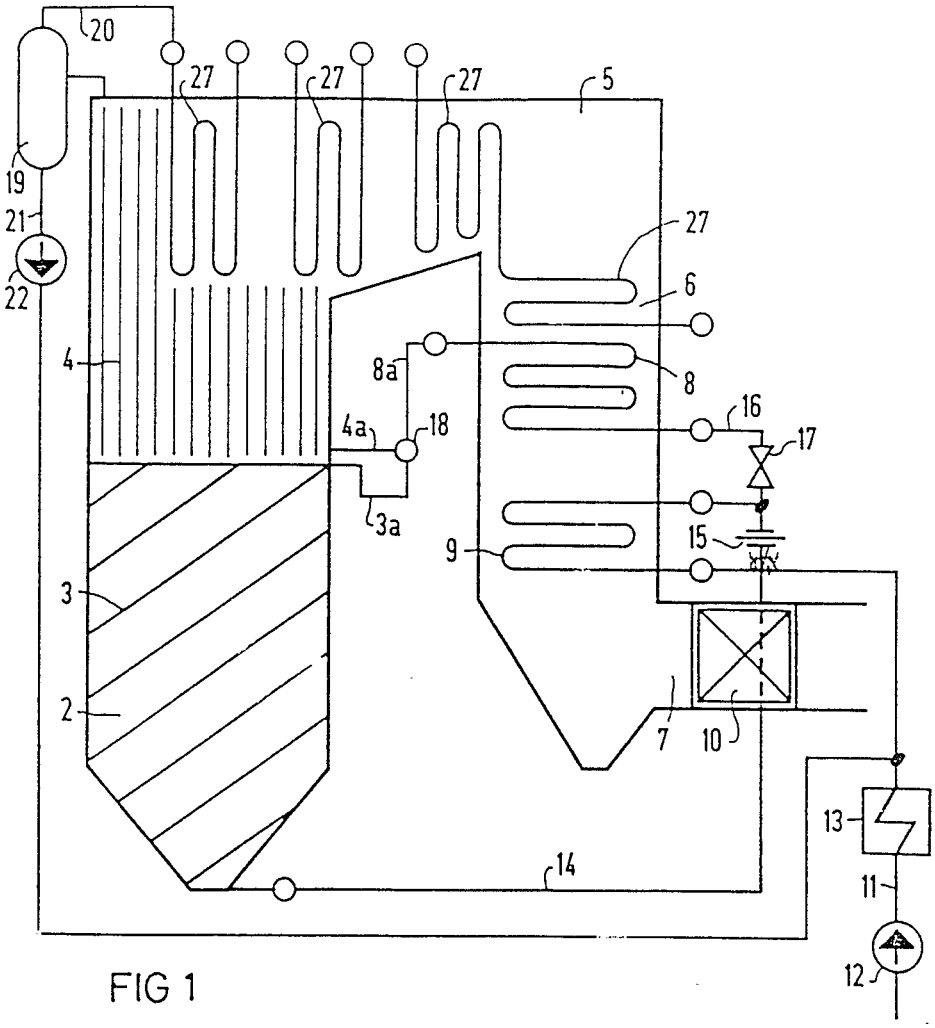
FIG. 1 is a diagrammatic view of a once-through steam generator constructed in accordance with the invention.
Figure 2:
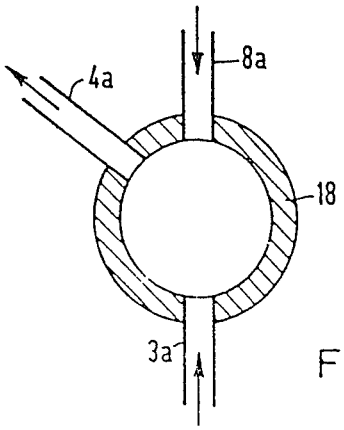
FIG. 2 is a cross-sectional view of a straight-through header or accumulator of the once-through steam generator of FIG. 1.
Figure 3:
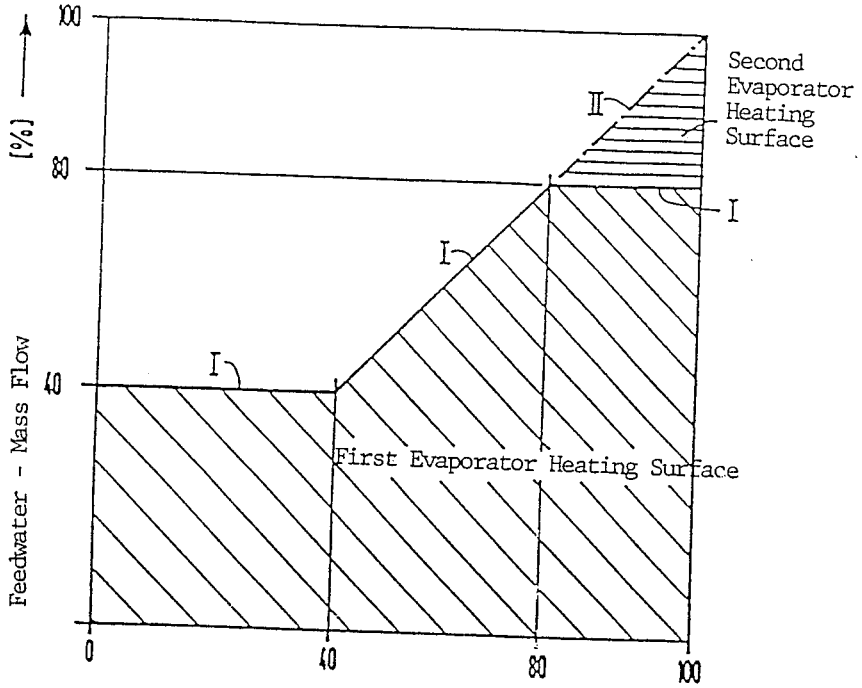
Figure 4:
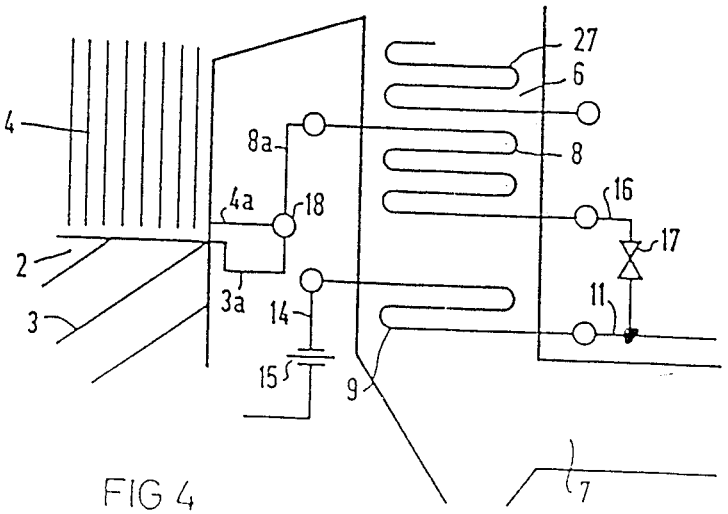

FIG. 3 is a plot diagram of respective percentages of feedwater flow rate and steam generator load, thereby illustrating the operation of the once-through steam generator of FIGS. 1 and 2; and FIG. 4 is fragmentary diagrammatic view of another embodiment of the invention showing the interconnection of heating surfaces in the convection chamber of the once-through steam generator of FIG. 1 in somewhat modified form.

Referring now to the drawing and, first, particularly to FIG. 1 thereof, there is shown a once-through steam generator having a combustion chamber 2, for example with non-illustrated coal-dust burners, which terminate in this combustion chamber 2. The combustion chamber 2 is defined by a tubular wall 3 which constitutes a first evaporator heating surface.

On the flue-gas side, the combustion chamber 2 is followed by a jet chamber 4 having a horizontal draft passage 5, which merges with a convection chamber 6 having a flue-gas outlet channel 7. The jet chamber 4, the horizontal draft passage or flue 5 and the convection chamber 6 have gas-tight tube walls cooled by water vapor.

High-pressure superheating surfaces and inermediate superheating surfaces 27 are provided within an upper part of the jet chamber 4, inside the horizontal draft passage 5 and inside an upper part of the connection chamber 6. A second evaporator heating surface 8 and an economizer heating surface 9 are disposed within the convection chamber 6, on the flue-gas side downstream from these high-pressure and intermediate superheating surfaces 27. The flue-gas outlet channel 7 leads to an installation 10 containing catalysts for removing nitrogen oxide from the flue gas.

A feedwater pipeline 11 having a feedwater pump 12 and a feedwater preheater 13 connected therein leads to the economizer heating surface 9.

On the water side thereof, the economizer heating surface 9 is connected, via a pipeline 14 containing a flow meter 15, to the tube wall 3 forming the first evaporator heating surface and, via another pipeline 16 containing a waterregulating valve 17, to the second evaporator heating surface 8 located in the convection chamber 6. The second evaporator heating surface 8 with the water regulating valve 17 connected thereto upstream thereof is, in turn, connected on the water side in parallel with the tube wall 3 forming the first evaporator heating surface and, on an outlet side thereof, to a straight-through header or accumulator 18 which, as is shown in FIG. 2, is basically a tube in which an outlet 3*a* of the first evaporator heating surface 3 and an outlet 8*a* of the second evaporator heating surface 8 terminate at locations diametrically opposite one another.

Pipelines 4*a* extend radially away from the straight-through header 18 to the tube wall of the jet chamber 4.

Downstream from the tube wall of the jet chamber 4 is a water/steam separating receptacle 19, having a steam-side outlet 20 connected to a high-pressure superheating surface 27, and a water-side outlet 21 in which a pump 22 is connected, both of said outlets 20 and 21 leading to the water-side inlet of the economizer heating surface 9. This water/steam separating receptacle 19 may also be located downstream of outlets of the tube wall 3 forming the first evaporator heating surface and of the second evaporator heating surface 8.

In the plot diagram of FIG. 3, the load of the once-through steam generator is shown along the abscissa as a percentage of full load, and the mass feedwater flow or feedwater flow rate in the once-through steam generator is shown along the ordinate as a percentage thereof at full load.

The solid line I represents the feedwater mass flow or flow rate through the pipeline 14 into the tube wall 3 forming the first evaporator heating surface 3, and the dot-dash line II represents the feedwater mass flow or flow rate through the pipeline 16 into the second evaporator heating surface 8, which is disposed in the convection chamber 6. In this regard, it is noted that, the water entering the two evaporator heating surfaces 3 and 8 is also referred to as feedwater.

At partial load, less than or equal to, for example, 40% of full load, the water regulating valve 17 is closed, and a circulating mass flow of water pumped by the pump 22 is superimposed on the feedwater mass flow pumped by the feed pump 12 through the tube wall 3 forming the first evaporator heating surface, so that the total mass flow or flow rate of water through the tube wall 3 has the same value at any partial load up to 40% of full load.

At a partial load greater than 40% of full load, the water regulating valve 17 initially remains closed yet; the mass flow or the flow rate of recycling water pumped by the pump 22 is zero; and the mass flow or flow rate of feedwater through the tube wall 3 forming the first evaporator heating surface increases linearly with the load of the once-through steam generator.

Only when the flow meter 15 in the pipeline 14 indicates that there is in the tube wall 3 a feedwater mass flow or flow rate of 80%, for example, of the feedwater mass flow or flow rate in the once-through steam generator at full load, does the water regulating valve 17 open. Upon a further increase in the load of the once-through steam generator, the water regulating valve 17 is always opened only just widely enough that the feedwater mass flow or flow rate through the pipeline 14 into the tube wall 3 will always constantly remain at the value of 80% of the feedwater mass flow or flow rate in the once-through steam generator at full load, while the portion of this feedwater mass flow which exceeds 80% is delivered to the second evaporator heating surface 8.

Because the friction pressure loss in the first evaporator heating surface formed of the tube wall 3 is always greater than the friction pressure loss in the second evaporator heating surface 8, due to the intense heating in the combustion chamber 2 and the consequently required high flow speed in the tubes of the tube wall 3, the friction pressure loss of the two evaporator heating surfaces 3 and 8 connected in parallel on the water side does not increase significantly above the friction pressure loss at 80% of full load, when the load is greater than 80% of full load and even is greater in the partial-load range with the second evaporator heating surface 8 shut off, than in the once-through steam generator of FIG. 1.

Advantageously, the water regulating valve 17, in the closed position thereof, can nevertheless permit a slight mass flow of feedwater into the second evaporator heating surface 8, so that this evaporator heating surface 8, at partial load, does not become excessively hot in the flue gas.

The lower the partial load of the once-through steam generator at which the partial feedwater flow is diverted into the second evaporator heating surface 8 by opening the water regulating valve 17, the more advantageously the system functions. With a conventional non-illustrated regulating or control device, the partial mass flow of the feedwater into the first evaporator heating surface 3 can therefore be prescribed a value which is not to be exceeded, and which may, for example, be constant or just high enough that the steam temperature at the outlet of the tube wall 3 forming the first evaporator heating surface does not exceed a permissible threshold value.

If the water regulating valve 17 is opened above a predetermined partial load of the once-through steam generator, for example, above 80% of full load of the once-through steam generator, then it can also be used as an injection valve for other heating surfaces, which are post-connected on the water side to the two evaporator heating surfaces 3 and 8.

Upon the occurrence of load changes or firing disruptions, the feedwater mass flow into the once-through steam generator can therefore be briefly increased or reduced. The water regulating valve 17 is opened or closed in synchronism, so that the partial mass flow of feedwater into the first evaporator heating surface formed by the tube wall 3 is maintained at the prescribed value. The change in the mass flow of feedwater into the once-through steam generator very quickly affects the temperature of the heating surfaces which are post-connected on the water side to the two evaporator heating surfaces 3 and 8, because the length of the tubes of the second evaporator heating surface 8 is considerably less than that of the tubes of the tube wall 3 forming the first evaporator heating surface.

The foregoing is a description corresponding in substance to German Application P 37 31 728.8, dated Sept. 21, 1987, the International priority of which is being claimed for the instant application, and which is hereby made part of this application. Any material discrepancies between the foregoing specification and the aforementioned corresponding German application are to be resolved in favor of the latter.

What is claimed is:

1. A method of operating a once-through steam generator having a first evaporator heating surface formed of a tube wall of a combustion chamber, and a second evaporator heating surface connected in parallel to the first evaporator heating surface at a water inlet side thereof, the second evaporator heating surface being located in a convection chamber post-connected to the combustion chamber at a flue-gas outlet side thereof downstream from a superheating surface as viewed in a flow direction of flue gas, which comprises opening a water regulating valve preconnected to the second evaporator heating surface in the flow direction of the feedwater, if a predetermined value of a mass flow of the feedwater into the once-through steam generator is exceeded, so as to initiate a partial mass flow of the feedwater into the second evaporator heating surface; and closing the water regulating valve again, if the predetermined value fails to be attained, so as to terminate the partial mass flow of the feedwater into the second evaporator heating surface.

2. A method according to claim 1, which includes varying the opening of the water regulating valve to adjust the partial mass flow of the feedwater into the second evaporator heating surface so that the partial mass flow of the feedwater into the first evaporator heating surface does not exceed a predetermined value.

3. A method according to claim 2, which includes respectively increasing and reducing momentarily the mass flow of feedwater into the once-through steam generator.

* * * * *